US009970259B2

(12) United States Patent
Felthager

(10) Patent No.: US 9,970,259 B2
(45) Date of Patent: May 15, 2018

(54) DUMP VALVE ARRANGEMENT FOR FRACTURING TOOL SET

(71) Applicant: Michael Felthager, Trinidad, CO (US)

(72) Inventor: Michael Felthager, Trinidad, CO (US)

( * ) Notice: Subject to any disclaimer, the term of this patent is extended or adjusted under 35 U.S.C. 154(b) by 0 days. days.

(21) Appl. No.: 14/594,099

(22) Filed: Jan. 10, 2015

(65) Prior Publication Data

US 2015/0308223 A1 Oct. 29, 2015

Related U.S. Application Data

(63) Continuation-in-part of application No. 13/200,317, filed on Sep. 23, 2011, now abandoned.

(51) Int. Cl.

| | |
|---|---|
| ***E21B 34/06*** | (2006.01) |
| ***E21B 34/12*** | (2006.01) |
| ***E21B 43/26*** | (2006.01) |

(52) U.S. Cl.

CPC ..... *E21B 34/06* (2013.01); *E21B 34/12* (2013.01); *E21B 43/26* (2013.01)

(58) Field of Classification Search

CPC .... E21B 34/14; E21B 2034/007; E21B 34/12; F16K 3/265

USPC ..... 166/373, 334.1; 251/349, 353

See application file for complete search history.

(56) References Cited

U.S. PATENT DOCUMENTS 2,912,216 A * 11/1959 Conrad ..... E21B 34/12 166/334.1

2002/0062963 A1* 5/2002 Eslinger ..... E21B 43/26 166/308.1

* cited by examiner

*Primary Examiner* — George Gray

(74) *Attorney, Agent, or Firm* — Alfred F. Hoyte, Jr.

(57) ABSTRACT

A dump valve arrangement for a fracking tool coupled to a length of coil tubing includes an axially displaceable inner mandrel which cooperates with a valve arrangement to allow for releasing fracturing fluid through the central bore of a fracturing tool to an outlet port positioned at the bottom of the tool string. Displacement of the inner mandrel is effected as a result of the normal sequence of operation of the fracturing tool set.

6 Claims, 4 Drawing Sheets

DUMP VALVE ARRANGEMENT FOR FRACTURING TOOL SET

CROSS REFERENCE TO RELATED APPLICATION

This application is a continuation in part of application Ser. No. 13/200,317.

BACKGROUND OF THE INVENTION

Field of the Invention

The present invention concerns methods of extracting petroleum. In particular, the invention concerns an improved method of stimulating fluid flow in a well bore using a fracturing tool assembly with an interiorly disposed dump valve.

Description of the Prior Art

Petroleum production from a well bore is often enhanced by a process that is characterized as fracturing or fracking. According to the general principles of fracking, the fracturing process induces increased fluid flow from the well bore production face by generating additional cracks and fissures into the zone surrounding the well bore wall. The objective of creating cracks and fissures in the fracking zone is an increase in the production face area. This increased production area facilitates flow of a greater volume of petroleum fluid into the well production flow stream than would otherwise occur from the penetration area provided by the original borehole.

Among the known methods of creating or enlarging such cracks and fissures into a fluid production zone is that of forcing liquid into the formation under extremely high pressure. Mixed with the high pressure fracturing liquid are particulates such as coarse sand or fine gravel known as proppants. These proppants have the function of holding open and maintaining the permeability of zone fractures. A zone is fluidly isolated from other zones in the well bore by a suitable sealing means such as inflatable packers so that the fluid, including the proppant, is forced into the well bore thereby creating fissures which stimulate the flow of oil.

A problem occurs when fracking multiple zones within the same well bore. Unloading or releasing the fracking liquid when moving from one zone to the next is harmful to the tool set. The fracking liquid is highly abrasive and since prior art tools generally release the liquid from openings positioned on the side of the tool set the tools are damaged over time from the effects of the abrasive fluid contacting the portions of the tool below the release point.

SUMMARY OF THE INVENTION

A dump valve arrangement for a fracking tool coupled to a length of coil tubing includes an axially displaceable inner mandrel which cooperates with a valve arrangement to allow for releasing fracturing fluid through the central bore of a fracturing tool to an outlet port positioned at the bottom of the tool string. Displacement of the inner mandrel is effected as a result of the normal sequence of operation of the fracturing tool set. The valve arrangement is in a closed position during both the insertion and positioning of the tool string. Fluid pressure from the injection of fracturing fluid into the formation maintains the inner mandrel and valve arrangement in the closed position. When fluid injection ceases, withdrawal of the coil tubing unit causes axial displacement of the inner mandrel thereby opening the valve arrangement, allowing fluid to drain through the center of the tool string and out into the well bore through the outlet port.

It is a major object of the invention to provide a release valve arrangement for releasing fluid trapped in a fracturing tool set.

It is another object of the invention to provide a release valve arrangement for a fracturing tool set which can be integrated into a standard fracturing tool set.

It is another object of the invention to provide a release valve arrangement for a fracturing tool set which release fluid evenly into the annulus of the tool set.

It is another object of the invention to provide a release valve arrangement for a fracturing tool set which does not require electrical activation.

It is another object of the invention to provide a release valve arrangement for a fracturing tool set which is actuated by the normal operation of a coil tubing unit.

Finally, it is a general goal of the invention to provide improved elements and arrangements thereof in an apparatus for the purposes described which is dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered with the accompanying drawings, in which like reference characters designate the same or similar parts throughout the several views, and wherein.

DETAILED DESCRIPTION OF THE PREFERRED EMBODIMENTS

Figure 1:
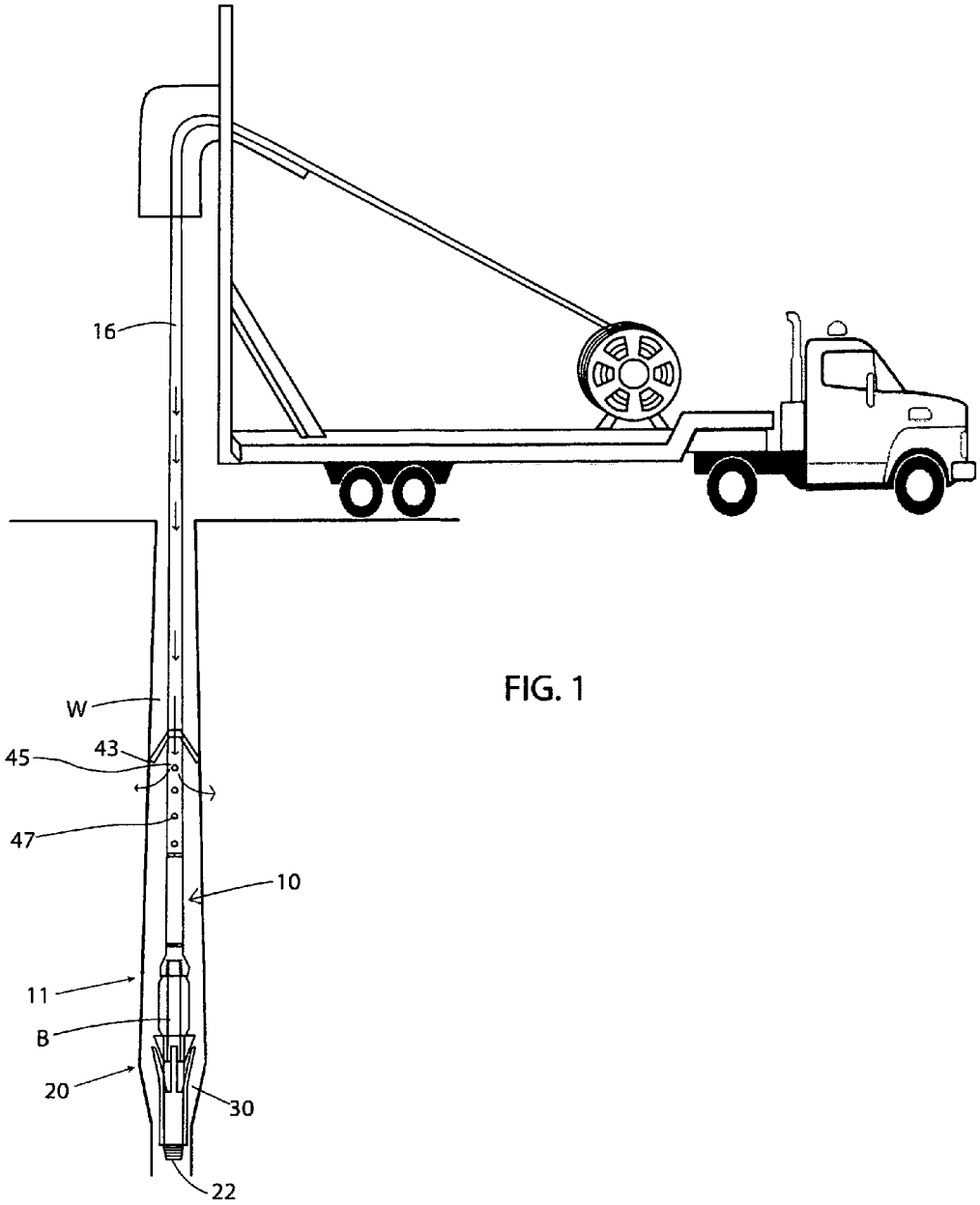
FIG. 1 shows a side sectional view of a fracking operation employing the tool set of the present invention.
Figure 2:
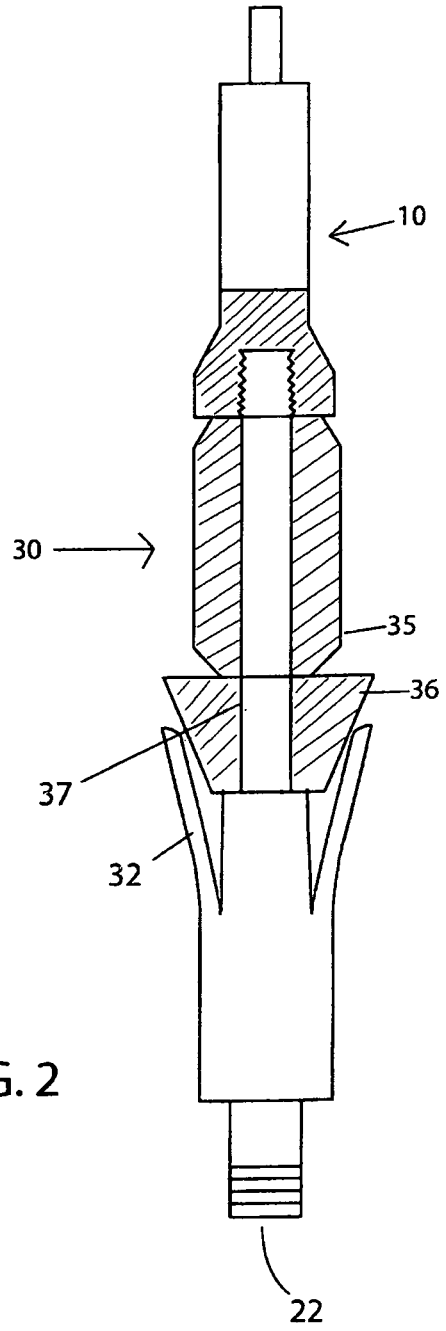
FIG. 2 shows a side view, partly in section, of the dump valve portion of the tool set connected to a standard bottom hole assembly.

Referring now to FIGS. 1-5, the dump valve arrangement of the present invention, generally indicated by the numeral 10, is shown. Referring particularly to FIG. 1 it can be seen that the invention is to be utilized with a standard fracking arrangement or tool set 11, including a coil tubing unit 12 mounted on a derrick 14 for raising/lowering a length of coil tubing 16 and the fracking tool to a desired location within a well bore W. The arrangement 11 is connected to one end of the coil tubing 16, and is adapted for fluid coupling with tubing 16 which has a plurality of ports 47 formed at its distal end for releasing fracking fluid into the well bore W as is well known in the art. The arrangement 11 includes a central bore B to which the coil tubing 16 is fluidly coupled, the bore B extending through all components connected thereto, the arrangement 11 terminating at a bottom hole assembly 20 including an outlet port 22 for releasing fluid when the dump valve 10 is in the open position, which position is obtained through the normal operation of the coil tubing unit 12 as will be explained in more detail later.

The bottom assembly 20 includes frusto-conical end portion 30 which includes the centrally positioned outlet port 22. The end portion 30 also includes a plurality of radially spaced slips 32 which are spring loaded, biased in the non-extended position as shown. End cap 35 is slidably disposed about inner mandrel 37 with cone 36 threadably secured to end cap 35. Downward movement of end cap 35 (due to lowering of tool string) causes engagement of the cone 36 with the angled inner surface of the slips 32 causing them to move radially outward into engagement with the well bore W casing in a manner well known in the art. The exact configuration of the bottom hole assembly 20 is not described in detail as it is well known in the art and does not form a part of the invention.

Figure 3:
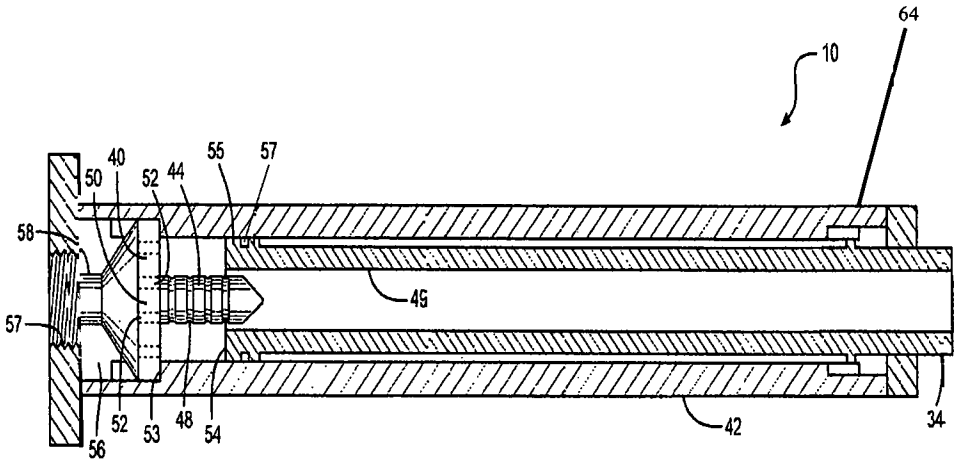
FIG. 3 shows a cross section of the valve body.
Figure 4:
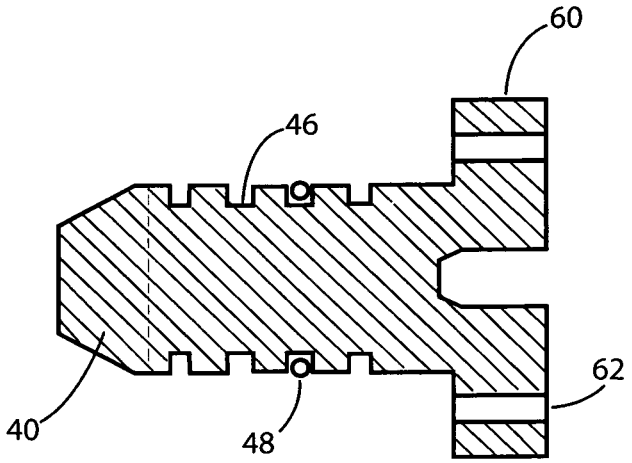
FIG. 4 shows a plan view of the valve member.
Figure 5:
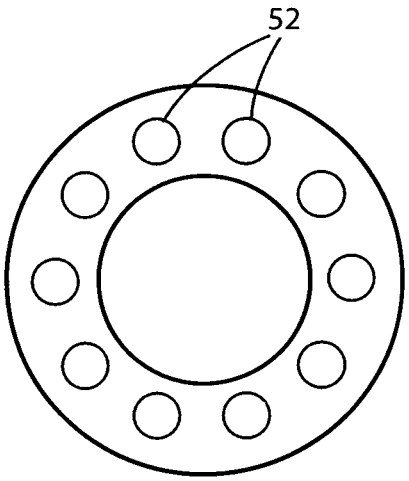
FIG. 5 shows a top view of the valve member illustrating the ports.

Referring now to FIGS. 3-5 the valve assembly 10 is shown in detail. It can be seen that the assembly consists of two components, an inner mandrel 34 and a plug member 40, the plug member 40 engageable within an elongated main body 42 and secured against axial displacement as will be described below. The valve assembly 10, shown in the open (unloading or dumping) position in FIG. 3, is connected between the top cup 43 and the bottom hole assembly 20. A conduit 45 threadedly connected between top cup 43 and valve assembly 10 has a plurality of apertures 47 for releasing fracking fluid into the formation. The conduit 45 as shown is connected directly to the coil tubing 16 but, as would be apparent to one of skill in the art, there may be other components or tools connected both above and below the conduit 45 for performing various tasks. The assembly 10 is designed for connection between a fluid release conduit such as conduit 45 and a bottom hole assembly such as bottom hole assembly 20, but is preferably always connected directly to the bottom hole assembly 20 to ensure that main body 42 remains stationary during the fracking operation. The bottom hole assembly 20 is anchored into the well bore W and is therefore stationary during the fracking operation. Regardless of where the assembly 10 is connected, operation of the valve 10 depends upon axial displacement of the mandrel 34. This axial displacement of the mandrel 34 is caused by moving the coil tubing 16 (and any other tools or components connected thereto) in the vertical direction. Vertical movement of the coil tubing 16 is an unavoidable consequence of the fracking operation. In particular, the coil tubing unit 16 must be moved downward before applying fluid pressure for fracking, and downward pressure from the fluid maintains the unit 16 in this downward position. Mandrel 34 is connected as by threading (indirectly as discussed above) to the coil tubing unit 16 and thus must move when the coil tubing moves. At the end of the fracking operation, the tubing unit 16 must be pulled upward to remove the tool sets from the well bore W thereby releasing the valve 10 in the manner described below.

The assembly 10 is essentially a plug type valve having a substantially cylindrical plug 44 with a series of axially spaced annular grooves 46 formed thereon for receiving annular sealing members 48. Sealing members 48 may be standard O-ring seals or other flexible and/or elastomeric members as would be apparent to one of skill in the art, the member 48 in sealing engagement with inner wall 49 of inner mandrel 34 when the assembly 10 is in the closed position, i.e., when the plug 44 fully inserted into mandrel 34. The sealing members 48 prevent fluid leakage from seat 54 into and through bore B when the assembly is in the closed position. Plug 44 depends from annular collar 50, the collar 50 having a plurality of regularly spaced bores or ports 52 which form conduits for fluid flow when the valve assembly 10 is in the open position as shown in FIG. 3. An annular seat 53 formed in the inner surface of the main body 42 is sized to retain collar 50, the seat 53 having an inner diameter slightly greater than the outermost edges of ports 52 to allow unobstructed fluid flow though the ports 52. Inner mandrel 34 is slidably positioned within main body 42 and includes at its bottom end a valve seat 54 which is sized for sealing engagement with collar 50 of plug member 40. Valve seat 54 is formed of a collar 55 positioned on the bottom end of mandrel 34, the collar 55 having a diameter equal to the inner diameter of valve main body and includes an annular groove 57 within which an O-ring seal or the like may be inserted. When collar 50 is firmly seated within valve seat 54 ports 52 are sealed and fluid flow through bottom gland 56 into and through bore B and out of port 22 is blocked. As stated above, the initial downward motion of the tool string and coil tubing 16, followed by fluid pressure from the fracking operation maintains the mandrel 34 in position to maintain the seal and therefore allow force fracking fluid through apertures 47 in conduit 45. Thus, collar 50, plug 44, and valve seat 54 form a valve mechanism which is actuated by axial displacement of inner mandrel 34, which, as previously stated, is effected during normal operation of the fracking arrangement 11.

Bottom gland 56 is threadedly secured to the plug end of valve main body 42 and serves to secure valve assembly 10 to the bottom hole assembly via threaded opening 57, the bottom gland also serving to prevent axial movement of plug 44. The interior surface 58 of bottom gland 56 tapers outwardly to form a conical passage 60 having its large diameter opening positioned securely against collar 50, the opening having a sufficiently large diameter to allow unobstructed fluid flow through ports 52 unless blocked by valve seat 54 as explained above. Mandrel 34 is slidably secured within main body 42 at its top end by top gland 64 which provides a seal against contaminants (i.e. particulate matter) which could otherwise enter main body 42 and interfere with smooth axial transitioning of mandrel 34 between the open and closed positions.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims.

I claim:

1. A valve for a fracturing tool set, said tool set attached to a length of coil tubing supplied with fracturing fluid under pressure, the valve comprising:

an elongated outer body fluidly coupled between said coil tubing and a bottom portion of said tool set;

an inner mandrel slidably positioned within said outer body, said inner mandrel having a valve seat formed at a sealing end thereof;

a plug member formed at one end of said outer body, said plug member having a series of annularly arranged ports formed therein said ports each having a longitudinal axis substantially parallel to a longitudinal axis of the elongated outer body, said plug member having an annular collar, said annular collar sized for sealing engagement with said valve seat;

whereby fracturing fluid pressure in said coil tubing maintains the valve in a closed position and axial displacement of said coil tubing moves the valve to an open position; and wherein an outlet port is positioned downstream of all tool set components and is axially aligned with said coil tubing to allow discharge of fracturing fluid through said tool set, the outlet port being in fluid communication with the plug member ports when the valve is in the open position.

2. The tool set of claim 1 wherein said axial displacement is a part of a fracturing operation.

3. The tool set of claim 1 wherein said valve is inserted in the fracturing tool set assembly between the coil tubing and a bottom hole assembly.

4. The tool set of claim 1 wherein said valve is in the closed position during insertion and positioning of the tool set.

5. The valve of claim 1 wherein said plug member includes a series of annular sealing members engageable within said mandrel for preventing fluid flow within said mandrel when the valve is in the closed position.

6. The valve of claim 1 wherein said sealing end of said mandrel includes a sealing member exteriorly positioned for preventing fluid flow exteriorly of said mandrel when the valve is in the closed position.

* * * * *